United States Patent [19]

Evans

[11] Patent Number: 4,766,713

[45] Date of Patent: Aug. 30, 1988

[54] PACKAGING DEVICE INCLUDING DUAL CLIP ATTACHMENT APPARATUS, A CASING BRAKE MECHANISM AND GATHERING MECHANISM

[75] Inventor: Alfred J. Evans, Raleigh, N.C.

[73] Assignee: Delaware Capital Formation, Inc., Wilmington, Del.

[21] Appl. No.: 78,188

[22] Filed: Jul. 27, 1987

[51] Int. Cl.[4] ..... B65B 51/04

[52] U.S. Cl. ..... 53/138 A; 29/243.57; 17/41

[58] Field of Search ..... 53/138 A, 576; 29/243.56, 243.57; 17/41, 49

[56] References Cited

U.S. PATENT DOCUMENTS

| | | | |
|---|---|---|---|
| Re. 30,196 | 1/1980 | Velarde | 29/243.57 |
| Re. 30,390 | 9/1980 | Kupcikevicius | 17/41 X |
| 3,383,754 | 5/1968 | Klenz . | |
| 3,543,378 | 12/1970 | Klenz | 29/243.57 |
| 3,583,056 | 6/1971 | Klenz . | |
| 3,751,764 | 8/1973 | Dobbert . | |
| 3,783,583 | 1/1974 | Dobbert | 29/243.57 X |
| 4,001,926 | 1/1977 | Velarde . | |
| 4,188,767 | 2/1980 | Piereder | 17/41 X |
| 4,306,334 | 12/1981 | Niedecker | 17/49 |
| 4,358,873 | 11/1982 | Kollross . | |
| 4,417,368 | 11/1983 | Washburn . | |
| 4,430,772 | 2/1984 | Michel et al. . | |
| 4,430,773 | 2/1984 | Becker et al. . | |
| 4,437,209 | 3/1984 | Duroyon . | |
| 4,442,568 | 4/1984 | Petry . | |
| 4,675,945 | 6/1987 | Evans | 17/41 X |

FOREIGN PATENT DOCUMENTS

| | | |
|---|---|---|
| 101100 | 3/1962 | Netherlands . |
| 976987 | 12/1964 | United Kingdom . |
| 598596 | 4/1975 | U.S.S.R. . |

*Primary Examiner*—John Sipos

*Attorney, Agent, or Firm*—Allegretti & Witcoff, Ltd.

[57] ABSTRACT

In the preferred embodiment of the invention, a brake mechanism for a clip attachment packaging device is movable both axially with respect to a product discharge horn in order to control release of casing from the horn and pivotally with respect to the horn in order to move out of alignment with the horn thereby permitting access to the horn for repair, replacement of casing, or other purposes. As a further feature of the invention, the clip attachment apparatus includes a specially constructed gathering mechanism comprised of a fixed jaw defining a first clip channel side or section cooperative with a movable jaw defining a second clip channel side or section. The fixed jaw and first clip channel are maintained in a fixed orientation in space. The movable jaw and second clip channel are translatable in two directions simultaneously toward the fixed jaw to thereby close about casing between the jaws prior to attachment of a metal clip about the casing.

19 Claims, 10 Drawing Sheets

3A
3A
4
4

PACKAGING DEVICE INCLUDING DUAL CLIP ATTACHMENT APPARATUS, A CASING BRAKE MECHANISM AND GATHERING MECHANISM

BACKGROUND OF THE INVENTION

This invention relates to an improved packaging device for filling tubular casing with products, such as sausage or cheese, and for attaching metal clips about the casing at intervals to thereby enclose the product.

It has been known for many years that various food products such as sausage or cheese can be packaged in tubular casing by attaching metal clips at the opposite ends of the casing product thereby sealing and closing the product within the casing. Klenz in U.S. Pat. No. 3,383,754 issued May 21, 1968 for a "Fluid Driven Mechanism with Protective Stroke for Applying a Clip Around a Casing" discloses a device especially adapted for applying U-shaped metal clips about casing. Specifically, Klenz teaches the use of a punch for driving a U-shaped metal clip down a channel against a die to thereby form the clip about gathered casing retained at the bottom of the clip channel.

Klenz in U.S. Pat. No. 3,543,378 discloses yet another clipping apparatus for applying U-shaped clips about gathered packaging material. U.S. Pat. No. 3,543,378 discloses the use of a pair of clippers arranged in tandem and cooperative with opposed, movable, casing gathering plates that define a pair of clip channels. The gathering plates move in opposition to each other to gather casing material into a constricted form. U-shaped metal clips are then driven by a punch about the gathered casing to seal the ends of the casing.

Klenz in U.S. Pat. No. 3,583,056 discloses yet another clip attachment apparatus wherein material which is to be clipped is retained by a movable jaw which pivots against a fixed jaw to gather casing material in a constricted region against the fixed jaw prior to attachment of a clip about the casing.

Dobbert in U.S. Pat. No. 3,783,583 discloses another variation of a gathering means for casing associated with a clip attachment apparatus. The gathering means compresses or gathers material simultaneously in two directions substantially at right angles to each other in order to optimize the sealing effect achieved by attaching a U-shaped clip about the gathered material. The gathering means includes a pivoting series of jaws cooperative with fixed jaws.

Velarde in U.S. Pat. No. 4,001,926 discloses a gathering means for a clip attachment apparatus comprised of a pair of movable jaws which compress casing material and which additionally includes a gathering bar cooperative with the movable jaws to further effect the gathering operation.

Velarde in U.S. Pat. No. Re. 30,196 discloses a gathering mechanism for a clip attachment apparatus wherein a movable jaw pivots to gather material against a fixed jaw.

Clip attachment apparatus mechanisms and gathering mechanisms of the type referenced have often been used in combination with a product discharge tube or horn. Typically the horn serves to discharge product into casing which is shirred or rucked on the horn. A brake may control release of the casing from the horn. Dobbert in U.S. Pat. No. 3,751,764 entitled "Casing Sizer" discloses a brake construction. The clip attachment apparatus and gathering mechanism are positioned at the discharge end of the horn to provide for attaching U-shaped metal clips about the casing to seal product therein.

While all of the various packing devices utilizing these prior art constructions has been useful, an improved gathering mechanism for such devices has been sought which places less stress on the casing or material being gathered. A known commercial product that attempts to accomplish this objective is known as the DCAE device. The DCAE device is described in greater detail below with respect to FIGS. 15, 16 and 17.

Still an improved gathering jaw mechanism which places less stress on the casing has been sought. Further, it is desirable to provide for a clipper mechanism wherein the clipper itself as well as any casing brake associated with a discharge horn for the device can be pivoted out of position in order to improve access for servicing and for placement of casing on the horn. Goals and objectives of this nature are, in part, the inspiration for the development of the present invention.

SUMMARY OF THE INVENTION

In a principal aspect, the present invention comprises an improved packaging device for filling tubular casing with product and for attaching clips about the casing at intervals to enclose the product. The device is of the type which includes a frame with a generally cylindrical, product discharge tube or horn mounted on the frame. Means are provided for feeding product into the horn at an inlet for ultimate discharge from the product outlet end into casing material as the casing material is released from the horn in a controlled manner by means of a brake mechanism. Clip attachment means are supported at the end of the horn for attaching U-shaped metal clips about the filled casing withdrawn from the horn.

In the preferred embodiment of the invention, the brake mechanism is movable both axially with respect to the horn in order to control release of casing from the horn and pivotally with respect to the horn in order to move out of alignment with the horn thereby permitting access to the horn for repair, replacement of casing, or other purposes. As a further feature of the invention, the clip attachment apparatus includes a specially constructed gathering mechanism comprised of a fixed jaw defining a first clip channel side or section cooperative with a movable jaw defining a second clip channel side or section. The fixed jaw and first clip channel are maintained in a fixed orientation in space. The movable jaw and second clip channel are translatable in two directions simultaneously toward the fixed jaw to thereby close about casing between the jaws prior to attachment of a metal clip about the casing. The specific construction of the jaws and the linkage connecting the jaws constitute an important feature of the invention.

Thus, it is an object of the invention to provide an improved packaging device for filling tubular casing and for attaching metal clips about the casing.

Another object of the invention is to provide an improved brake mechanism associated with a device for packaging products such as sausage or cheese in casing. Specifically, the brake mechanism is movable to control the release of casing from a product discharge horn and is also pivotal out of axial alignment with the horn.

A further object of the invention is to provide an improved gathering mechanism for gathering casing material prior to attaching a clip thereto by means of a clip attachment apparatus or clipper.

Yet a further object of the present invention is to provide a high speed and efficient packaging device for filling tubular casing with flow of a product from a discharge horn and for sealing the casing material to define generally uniform length segments.

Another object of the invention is to provide a packaging device for packaging product within casing which is easy to use, and which includes component parts that are accessible for repair or replacement.

Yet a further object of the invention is to provide an improved packaging device for packaging product in casing material by attaching U-shaped metal clips at intervals along filled casing as that casing is discharged from a discharge horn.

Another object of the invention is to provide a packaging device for attaching U-shaped metal clips to casing material filled with product discharged by a discharge horn wherein the clip attachment apparatus or clipper may be pivoted out of alignment with the discharge horn to thereby permit access to the horn for repair, replacement or placement of casing thereon.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

General Description of Packaging Device

Figure 1:
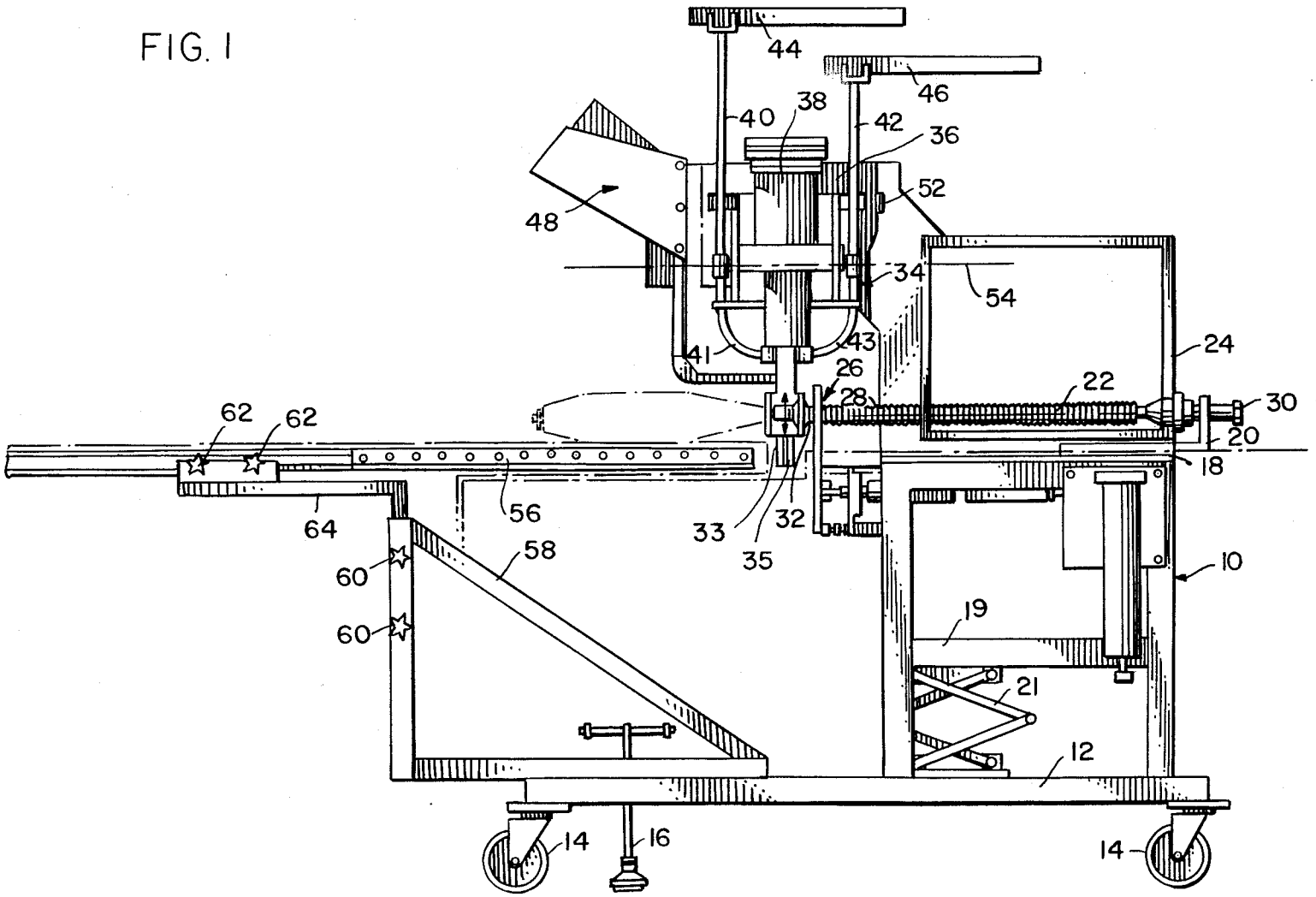
FIG. 1 is a side elevation depicting the overall layout of the improved packaging device of the present invention.

FIG. 1 depicts the general layout of the packaging machine or device of the present invention in a side elevation. This general layout is typical of such packaging devices. Thus, a support frame 10 includes a rectangular base or platform 12 mounted on wheels 14. The wheels 14 may be locked when the device is placed in an appropriate position in a food processing line, for example. Additionally, a frame or platform brake 16 may be lowered and engaged with the floor to retain the platform 12 and thus the frame 10 as well as the entire device in a fixed position relative to a processing line.

The frame 10 includes a series of cross supports and members supporting a platform 18 which, in turn, supports a bracket 20 that supports a product discharge horn 22. The support platform 18 for the horn 22 is preferably mounted on a movable carriage 19 supported by a vertically, telescoping bracket assembly 21. In this manner the vertical position or height of the horn 22 may be adjusted by adjusting the elevation of the platform 18.

Also mounted on the frame 10, adjacent the platform 18 and product discharge horn 22, is a control cabinet 24 which includes all of the pneumatic and other controls associated with the various cylinders, motors and the like that operate the component parts of the device. The device is principally operated by pneumatic power. However, electrical switches and controls are utilized to sequence pneumatic components, at least in part. All of these controls are retained in the cabinet 24.

A casing brake mechanism 26 is supported on the frame 10 for cooperation with the horn 22 in a manner to be described in greater detail below. The brake mechanism 26 is thus mounted to move with platform 18. Suffice it to say that the brake mechanism 26 controls the discharge or withdrawal of casing 28 which has been rucked upon the horn 22 as that casing 28 is being withdrawn from the horn 22 due to the passage of product through the horn 22 into casing 28. Thus, the horn 22 includes a product filling tube 30 attached at one end and an opposite discharge end 32.

Positioned immediately adjacent the discharge end 32 of horn 22 is a pair of clippers 33, 35 described in greater detail below, which form part of clip attachment means 34. The clip attachment means 34 is also supported on the main frame 10 by means of a support bracket assembly 36. Assembly 36 is adjustable vertically to compensate for vertical movement of platform 18 and to thereby properly position the clippers 33, 35 vertically relative to the platform. The assembly 36 also permits horizontal (left to right in FIG. 1) adjustment of clippers 33, 35 relative to the horn 22. The assembly 36 and cabinet 24 are also mounted for horizontal movement (into and out of the plane of FIG. 1) to accommodate further adjustment of clippers 33, 35 relative to horn 22. The support bracket assembly 36 thus supports a clip driving cylinder 38 which operates to simultaneously drive the pair of clippers 33, 35.

Supported from the bracket assembly 36 are first and second clip guide tubes 40 and 42 which connect respectively to clip storage trays 44 and 46. Tubes 40, 42 direct clips from the trays 44, 46 to feed rails 41, 43 and thence into vertical channels associated with the clippers 33, 35, respectively. A looper assembly 48, in which loops or carrying strings are stored for feeding to the clipper 33, is supported by a bracket which attaches it directly to the clipper 33. Loops from the reel assembly 48 feed through a looper feed mechanism and guide assembly to the clippers 33, 35. Thus, loops may be fed into the clippers 33, 35 for attachment to the food product during the clipping operation. Typically the loops are used to hang the product, such as sausage, on a hook.

The reel assembly 48 and clip attachment means 34 are all pivotally mounted by the bracket assembly 36 so that they may pivot into and out of alignment with the end 32 of the horn 22. Thus, bracket assembly 36 includes a pivot mounting, schematically depicted in FIG. 2 as mount 52, which permits pivoting of the total described clip attachment means 34 and associated reel assembly 48 about an axis 54 (see FIGS. 2 and 5).

Positioned just in front of the clip attachment means 34 in a generally horizontal plane and constituting an extension of the path from the horn 22 is a product conveyor 56. The conveyor 56 is supported on an adjustable brace construction 58 also mounted on the platform 12. Thus, the conveyor 56 may be raised or lowered depending upon, inter alia, the diameter of product discharged from the horn 22. This is effected by adjustment of manual knobs 60. The longitudinal position of the conveyor 56 may also be adjusted by actuation of the knobs 62 associated with the arm 64 of the movable bracket member 66 retained by the vertical upstanding tube 68 associated with the brace construction 58.

General Operation

The operation of the device depicted in FIG. 1 is generally as follows:

The inlet end 30 of the discharge horn 22 is appropriately aligned with a product pump having a discharge outlet (not shown). The discharge horn 22 is appropriately positioned as a result of movement of the platform 12 on its wheels or rollers 14 and appropriate height adjustment of the bracket assembly 21. Thus, the inlet 30, which includes a threaded nut 37 cooperative with a flange 39, is sealed against the product outlet of a pumping device. Typically, for example, a pumping device will be provided for discharge of sausage product, cheese product, or any other generally flowable product. The pumping device thus pumps the product into the discharge horn 22 in a controlled manner in response to controls in cabinet 24. As product is discharged into the horn 22, it passes through the horn 22 for exit at the discharge end 32.

Casing 28, which has been rucked on the horn 22 and which has been sealed at its open end is filled by product as it is withdrawn from horn 22. The filled casing 28 passes through an opening defined by gathering jaws of the clippers 33, 35 of the clip attachment means 34 and onto the support conveyor 56.

The brake mechanism 26 controls the release of the casing 28 from horn 22 during the filling operation. The brake mechanism 26 is thus positioned over the end 32 of the horn 22 during the filling operation. Operation of the pumping device (not shown) as well as the brake mechanism 26 and the clip attachment means 34 are all sequenced in response to controls retained within the control cabinet 24. The control circuitry and the control compounds are fabricated in accord with procedures and practices known to those of ordinary skill in the machine control art.

In any event, upon filling a fixed length increment of casing 28, the pumping mechanism ceases to pump material or product through the horn 22. The brake mechanism 26 then operates to release pressure on the casing 28. This will be described in greater detail below.

Substantially simultaneously the clip attachment means 34, which is comprised of two parallel clippers 33, 35 and includes gathering means (described in greater detail below), gathers a short section of the casing material 28 into a small diameter section or segment and fastens two U-shaped metal clips, side by side along the length of the gathered casing material 28. A knife then cuts the casing material between the two attached metal clips so that the packaged product which is resting on the conveyor 56 is now separate from the sealed end of the remainder of the casing 28. The packaged product is then released for movement down the conveyor 56 and the casing 28 on horn 22 is available for further filling. The described operation is then sequentially repeated.

The device includes a unique gathering means for gathering the casing 28 during the clipping operation, a unique pivoting mechanism associated with the clip attachment means 34 for moving the clip attachment means 34 out of alignment with the end 32 of the horn 22 to permit servicing of or access to the horn 22, and a unique brake mechanism 26 which moves axially with respect to the horn 22 and which also may be pivoted out of alignment with the axis of the horn 22. All of these mechanisms are described in greater detail below and provide for enhanced operation of the packaging device generally depicted in FIG. 1.

The Brake Mechanism—In General

Figure 2:
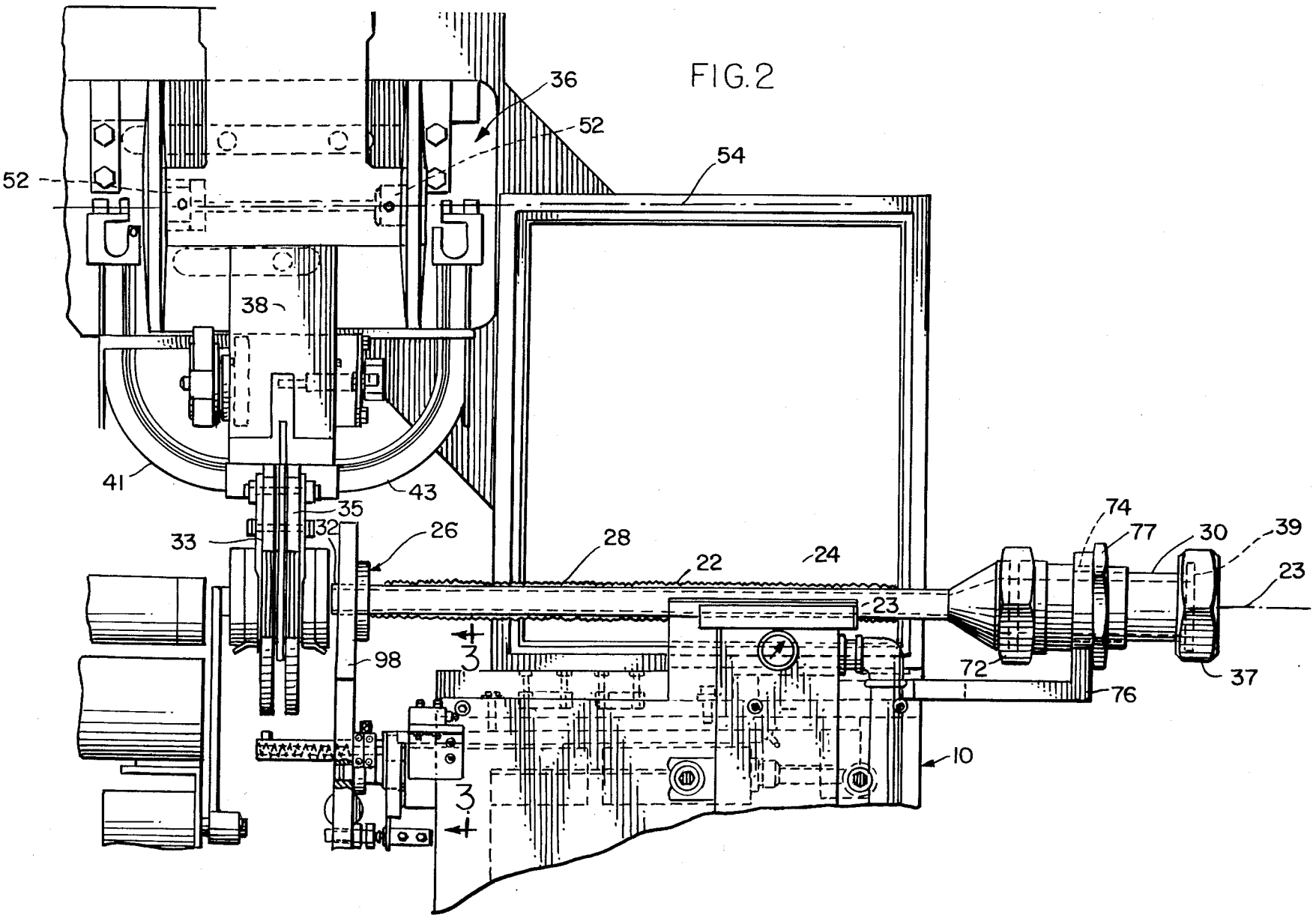
FIG. 2 is a side elevation of the brake mechanism associated with the product discharge horn incorporated in the device depicted in FIG. 1.
Figures 3, 3A, 4:
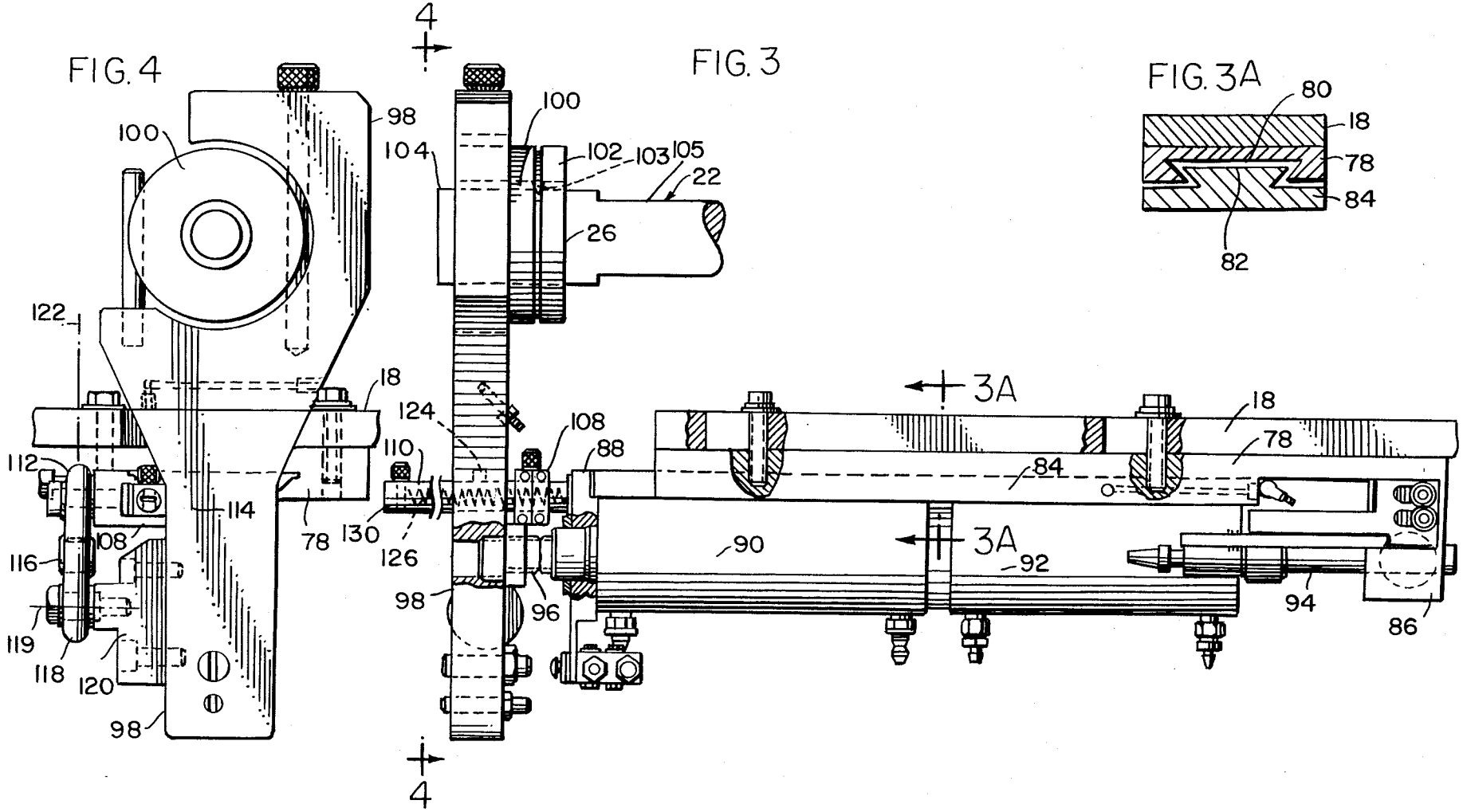
FIG. 3 is an enlarged side elevation view of the brake mechanism in FIG. 2.
FIG. 3A is a sectional view taken along the line 3A—3A in FIG. 3.
FIG. 4 is a sectional view of the brake mechanism taken along the line 4—4 in FIG. 3.

The brake mechanism 26 is depicted in greater detail in FIGS. 2, 3 and 4. As previously described, the mechanism 26 is cooperative with the horn 22. The horn 22 is mounted on a platform or carriage 18 which is adjustable in height. The brake mechanism 26 is attached to the platform or carriage 18 and is carried by that platform or carriage 18 so that it moves vertically therewith.

The horn 22 is retained in position with respect to the platform 18 by means of a nut 72 which serves to attach the horn 22 to the product filling tube 30. The horn 22 defines a longitudinal axis 23. The outside surface of tube 30 is threaded for cooperation with a threaded passage 74 of filling tube support bracket 76. The filling tube support bracket 76 is carried by the platform or carriage 18 for concomitant movement therewith. A lock nut 77 serves to lock the bracket 76 to tube 30. The filling tube 74 is adapted to connect with a pump (not shown) via nut 37. Adjustment of tube 30 in bracket 76 allows adjustment of the end 32 of horn 22 relative to plate 98 and the brake supported by that plate 98. This is a significant adjustment since it permits fine adjustment of the flow pattern of product from the end of the horn 22 into the casing as controlled by the brake mechanism 26.

Supported beneath the fixed platform and parallel to the axis 23 is a fixed guide plate 78. Fixed guide plate 78 includes a longitudinal guide channel 80 in FIG. 3A which receives a longitudinal slide 82 associated with a slidable mounting plate 84. Also affixed to the fixed guide plate 78 is a fixed mounting block 86.

Attached at the front end of the slidable plate 84 is a cylinder support bracket 88. The cylinder support bracket 88 directly supports a forward or front cylinder 90 by attaching that cylinder 90 to the slidable plate 84. Extending axially with respect to the front cylinder 90 is a second or skin brake cylinder 92 having a rod 94. Rod 94 is connected to the fixed mounting block 86. Actuation of the cylinder 92 will cause the rod 94 to effectively retract or extend into the cylinder 92. This effectively causes the plate 84 to slide with respect to the plate 78. Of course, this also causes the cylinders 90 and 92 to move coincidentally with the plate 84 since they are carried by plate 84.

Projecting from the front cylinder 90 axially is a forward cylinder rod 96. The forward cylinder rod 96 connects with a vertical brake support plate 98. During normal filling and clip attachment of casing 28, the rod 96 remains in the retracted position of FIG. 3. As such, the plate 98 retains a brake housing 100 which cooperates with a brake nut 102 and elastomeric ring 103 to define an annular brake cooperative with the horn 22 and more particularly with casing 28 rucked on the horn 22.

The Brake Mechanism—Normal Filling and Clipping Operation

Operation of cylinder 92, which is the skin brake cylinder, will thus cause the slidable plate 84 and attached vertical plate 98 to move axially along axis 23 in response to direct movement of the cylinder 92 relative to the rod 94. This causes the brake housing 100, member 103 and brake nut 102 to simultaneously move in an axial direction over the end of the horn 22 to effectively control release of casing. In other words, the right hand end of rod 94 (in FIG. 3) is fixed. As cylinder 92 moves over rod 94, plates 84, 98 move right or left.

In the preferred embodiment, the end of the horn 22 is defined by a increased diameter end section 104 adjacent a reduced diameter section 105. The flexible, generally elastic, annular member 103 which projects into engagement with the end 104 provides for controlled tension on the casing 28. In order to release tension on the casing 28, the cylinder 92 is actuated so as to foreshorten the length of the rod 94 and thus move the brake housing 100 as well as the elastomeric annular member 103 to the right in FIG. 3. This moves the brake 26 from disengagement with the end section 104 to a position over the reduced diameter 105 section of the horn. The casing 28 then is easily withdrawn or removed from the horn 22.

During actual operation of the device, movement of brake 22 relative to the large diameter end 104 of horn 22 is effected by the cylinder 92/rod 94. Such movement is effected upon filling of a desirable length of casing material prior to application of clips and gathering of the casing 28. That is, the casing 28 is effectively released by the brake mechanism 26 in order to permit casing 28 to be easily withdrawn from the horn 22 during the casing gathering and clipping operations. This also provides for increased volume of casing 28 into which product may back flow during the gathering and clipping operations. Conversely, the operation of the cylinder 92 is reversed to extend the rod 94 relative to cylinder 92 (i.e. move the cylinder 92 to the left in FIG. 3) thereby moving the elastomeric member 103 forward on horn 22 after the clipping operation. In this manner, member 103 pushes any excess product from between the casing 28 and the horn 22 as member 103 is again positioned over the increased diameter end 104 of the horn 22.

In sum then, the cylinder 92 and rod 94 are operative to control the position of the brake 100 axially with respect to the horn 22 during the product filling and clipping operations. The cylinder 92 thus controls the position of the brake 26 along the longitudinal axis 23 of the horn 22 only during such operations. That is, the elastomeric member 103 is maintained against the casing 28 and large diameter end 104 during filling of casing 28 to control release of casing 28. Member 103 is released from end 104 and thus is released from engaging the casing 28 when the casing 28 is being gathered and clipped. Such release is effected by positioning the member 103 over reduced diameter section 105 of horn 22.

The Brake Mechanism—Full Release From The Horn and Pivoting for Access to the Horn The cylinder 90 and associated rod 96 are actuated to remove brake mechanism 26 from cooperative and axial alignment with horn 22. Specifically, extension of rod 96 from cylinder 90 first moves plate 98 axially to the left in FIG. 3 away from horn 22 and then causes the plate 98 to pivot away from axis 23.

Thus, the rod 96, which is attached to the plate 98, is pivotal about the axis of the rod 96 when the rod 96 is appropriately extended.

Normally during the casing filling operations previously described, however, the plate 98 is held fixed in the position illustrated in FIG. 2 against a slide block 108. Block 108 is mounted on a square cross section slide bar 110 projecting axially from the support bracket 88 parallel to the axis 23 of the horn 22.

The slide block 108 supports a pivot link 112, as shown in FIG. 4, which pivots about an axis 114 transverse to the axis 23. The link 112 connects through a rotary linkage 116 to a second link 118 attached through a bearing block 120. Bearing block 120 is bolted to the plate 98. The link 118 pivots about an axis 119. The linkage or connection 116 between the link 112 and link 118 is a bearing connection which permits rotation of the link 112 relative to the link 118 about yet another axis 122. Thus, the connection between the links 112 and 118 can effectively twist. Moreover, the links 112 and 118 are mounted on bearings which permit pivoting as well as twisting about their respective axes 114 and 119.

The slide block 108, as previously mentioned, is mounted on the rod 110 and slidable along the rod 110 between the position illustrated in FIG. 2 and an extended position limited by a stop pin 124 in rod 110. The rod 110 is hollow and houses a tension spring 126 which connects the slide block 108 to a pin 130 at the end of the rod 110. Spring 126 acts to bias the slide block 108 toward the pin 130.

The plate 98 moves axially along axis 23 and to the left of the position in FIG. 3 in response to actuation of cylinder 90 and thus in response to extension of rod 96. Initially when the cylinder 90 is actuated and the rod 96 is extended, the slide block 108 biased by spring 126 moves to the left in FIG. 2 following the travel of plate 98. This results since block 108 engages against the plate 98 as it slides on rod 110. Thus, the entire brake mechanism 26 moves in the orientation depicted in FIGS. 2, 3 and 4 axially to the left. Because the slide block 108 follows on the rod 110 as the plate 98 moves to the left extended by the rod 96, the linkage 112/118 maintains the orientation of the plate 98 as depicted in FIGS. 3 and 4. In other words, the brake mechanism and, more particularly, plate 98 moves away from horn 22 along axis 23 so that brake components 100, 102, 103 no longer fit over horn 22.

Upon reaching the stop 124, the block 108 can no longer translate forward or to the left as illustrated in FIG. 2. However, the plate 98 will continue to move to the left as the rod 96 is extended from cylinder 90. The link 112 thus stops movement parallel to axis 23 and becomes fixed at stop 124 along rod 110. The link 118, however, continues to move to the left as it is carried by block 120. Since the length of connected links 112 and 118 is fixed, the continued movement of the plate 98 will cause the links 112 and 118 to pivot and rotate with respect to each other as block 120 continues on its path to the left in FIG. 2. That is, referring to FIG. 4, the links 117, 118 effectively pivot and twist about axes 114, 119 and 122. The links 112, 118 are then positioned in a generally straight line causing the plate 98 to pivot about the axis of rod 96. As the rod 96 reaches its full length of travel, the plate 98 is totally pivoted about the axis of rod 96 and out of position of axial alignment with the horn 22. The front of the horn 22 is thus exposed for service, repair, replacement or placement of additional casing thereon.

Reversing the operation of the cylinder 90 will cause the reverse effect to take place. That is, initially the plate 98 will pivot back into its oriented position with respect to the horn 22 depicted by FIG. 4. The block 108 will then be released from the stop 124 as the rod 96 is further withdrawn to the right in FIG. 2. The brake 100 will then ultimately be positioned again over the horn 22.

In sum then, the forward cylinder 90 and rod 96 operate to extend the brake mechanism 26 axially away from the horn 22 and to subsequently pivot the brake mechanism 26 and associated plate 98 so as to permit access to the horn 22. Operation of the cylinder 90 and rod 96 are effected only during replacement of casing 28 or repair of the horn 22 or other non-packaging operations of the packaging device.

During this phase of operation of the device, the clipper means 34 may also be pivoted out of position of alignment with the horn 22. Referring to FIG. 2, this pivoting action is achieved by means of pivoting the clipper means 34 about pivot mounting bearings 138, 140 depicted in FIG. 5 as described in greater detail below.

The Clipper Gathering Means

Figure 5:
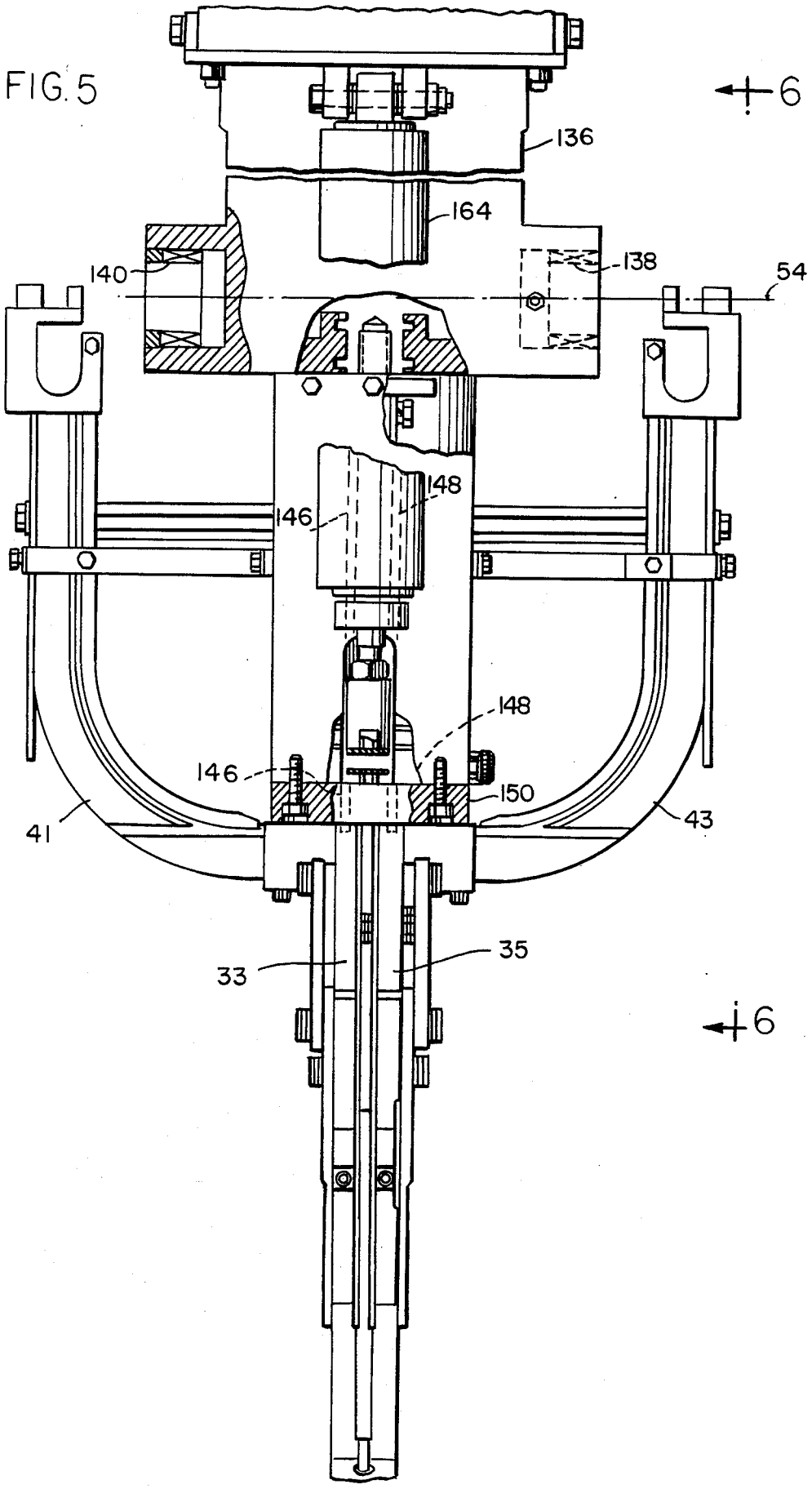
FIG. 5 is a side elevation of the clip attachment apparatus depicted in the overall layout of the device shown in FIG. 1.
Figure 6:
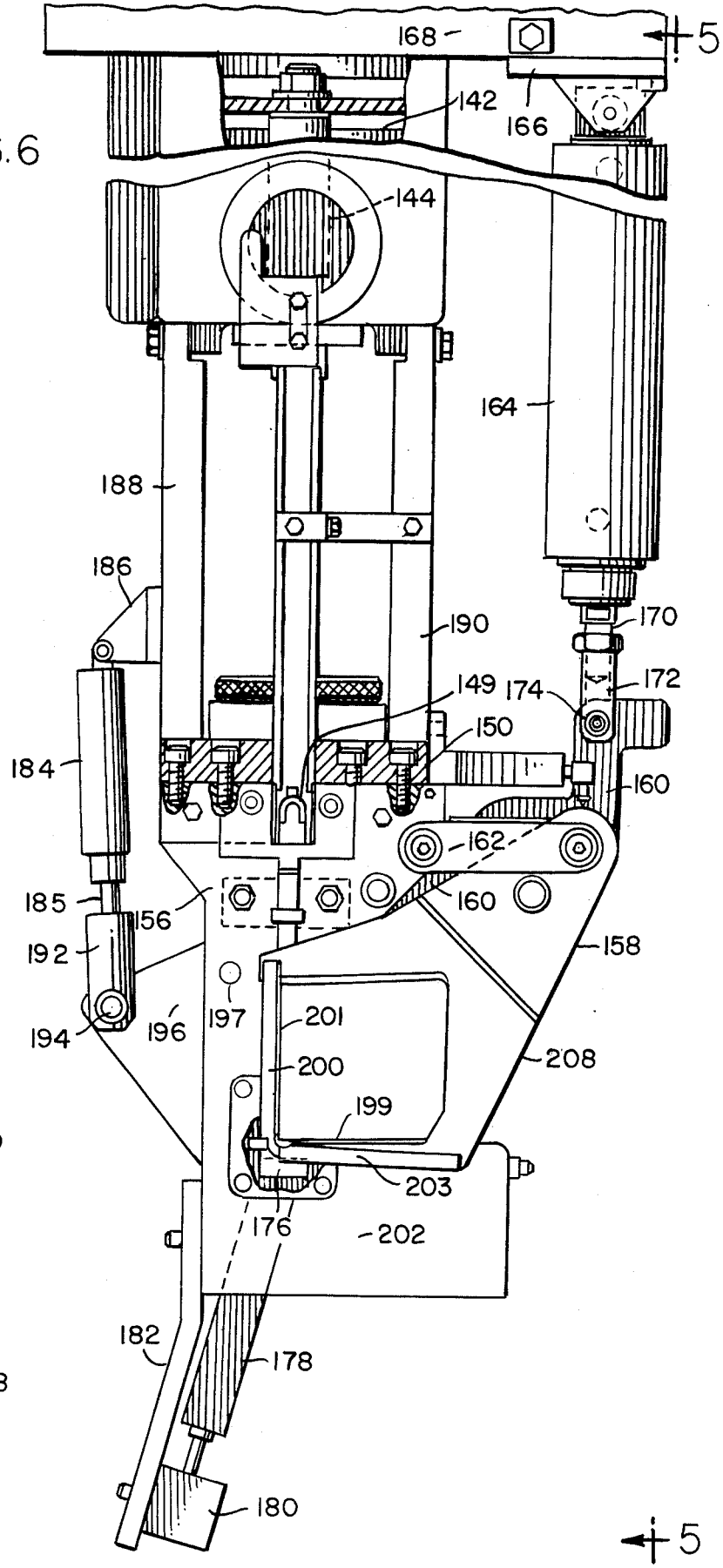
FIG. 6 is an end view of the clipper of FIG. 5 taken along the line 6—6.

FIGS. 5 and 6 illustrate the construction of the clipper means or mechanism 34 associated with the device of the present invention. The clipper mechanism 34 is a double clipper device used for simultaneously affixing two U-shaped metal clips about a segment of gathered casing material 28. The clipper mechanism 34 is designed to gather the casing material 28, subsequently apply two, spaced U-shaped metal clips about the gathered casing, cut the casing between the two applied clips, and then release the casing and facilitate ejection of the clipped product onto the conveyor 56. Specific unique features of the present development relate to the construction of the gathering jaws both alone and in combination with the remainder of the clipper components.

Referring therefore to the figures, the clipper means 34 includes a punch cylinder 136 which is supported on opposed bearing supports 138 and 140 about pivot axis 54. The cylinder 136 and thus the entire clipper mechanism 34 is pivotal about the bearing supports 138 and 140 so as to permit pivoting of the clipper mechanism 34 into alignment with the horn 22 or out of alignment with the horn 22 for the reasons previously explained.

The cylinder 136 includes a piston 142 which is pneumatically operated to drive a drive rod or shaft 144. The drive shaft 144 is mechanically coupled with a pair of clip punches 146 and 148 which ride through channels in a support plate 150 and extend into clip channels defined in the die support plates 156, 157. Clip channels are arranged to receive U-shaped metal clips (clip 149 in FIG. 6) from clip guide rails 41, 43. Clips are thus guided into channels beneath the punches 146, 148 for driving by the punches 148 and 146, respectively. Mechanisms of this general nature are well known and examples were referenced above.

The mechanism 34 also includes a fixed plate 156 which defines a fixed clip channel and a movable jaw or plate 158. Plate 158 is connected by first and second links 160 and 162 to plate 156. The fixed plate 156 thus defines a fixed channel to guide one leg of the U-shaped clip, for support of a clip forming die 176, and serve as a fixed jaw for gathering casing 28. The movable jaw or plate 158 defines a movable clip channel and gathering plate cooperative with the fixed channel and gathering plate.

The movable clip channel and gathering plate 158 are driven by operation of a cylinder 164 supported by a cylinder bracket 166 attached to a manifold assembly or plate 168 which is affixed to the punch cylinder 136. Cylinder 164 includes a drive rod 170 which connects through a link 172 and bushing 174 to driver 160 which drives the movable plate or jaw 158.

Figure 7:
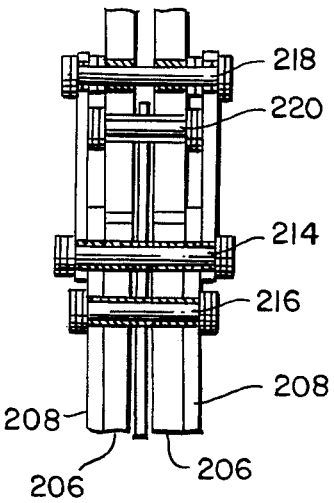
FIG. 7 is a cross sectinal view of the gathering means associated with the clipper mechanism of FIG. 6 taken along the line 7—7.

In operation, casing material 28 is positioned between the fixed jaw defined by plate 156 and the movable jaw defined by plate 158. The cylinder 164 then operates to close the movable jaw 158 on the casing material thereby gathering the material. In practice, since this is a double clipper, a series of movable plates or jaws are driven in unison by cylinder 164 to cooperate with a series of fixed plates or jaws. FIG. 7 is a cross section of the series of movable jaws.

The punch cylinder 136 then operates to drive the piston 142, shaft 144, and punches 146 and 148 down through channels in plate 150 to engage U-shaped metal clips 149. The U-shaped metal clips 149 are driven downward through the defined clip channels to engage against a fixed die 176 supported by the plate 156. Thereby the clips 149 are formed about the gathered material.

The next step in the operation is effected by means of a knife 178 driven by a cylinder 180 supported on a bracket 182 attached to the plates 156, 157. The knife 178 is actuated to sever the casing material 28 between the attached clips 149.

A voider cylinder 184 actuates at all times of clipping operation. That is, cylinder 184 is supported by a bracket 186 attached to a support leg or plate 188 which supports the plates 156, 157 to the assembly of cylinder 136. Likewise, a second support leg 190 cooperates to attach plates 156, 157 to assembly of cylinder 136. A voider cylinder 184 drives a rod 185 which is connected to a clevis 192 and pivot pin or bushing 194 to drive an L-shaped voider plate 196 pivotally about an axis of pin 197. Plate 196 effectively maintains a biasing force against the casing 28 intermediate the clips 149 which are to be attached. This force is effected by the horizontal edge 199 and vertical edge 201 of plate 196. Thus, edges 199 and 201 are biased by the cylinder 184 against casing 28 at all times. The plate 196 includes a central guide slot 203 for knife blade 178 as shown in FIG. 6.

Figure 15:
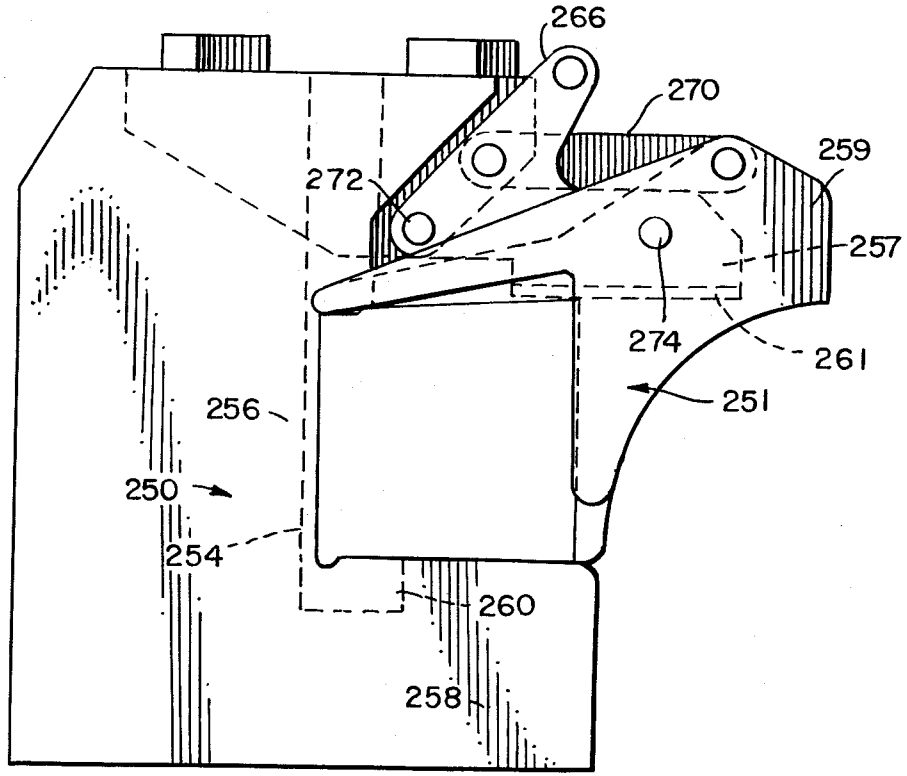
FIG. 15 PRIOR ART
FIGS. 15–17 are schematic views of the fixed and movable jaws associated with a prior art construction as the movable jaw moves between a fully opened to a fully closed position in 45° increments.
Figure 17:
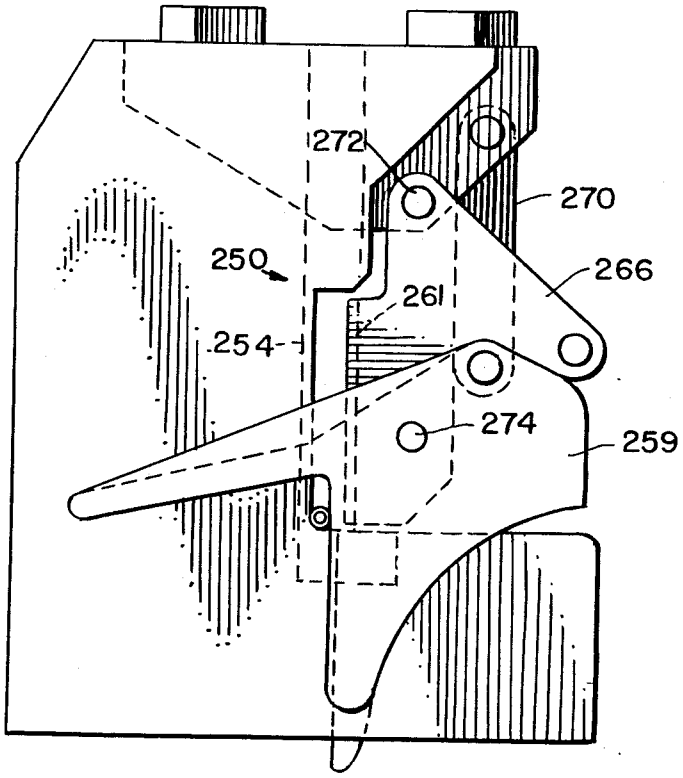
FIG. 17 PRIOR ART
Figure 16:
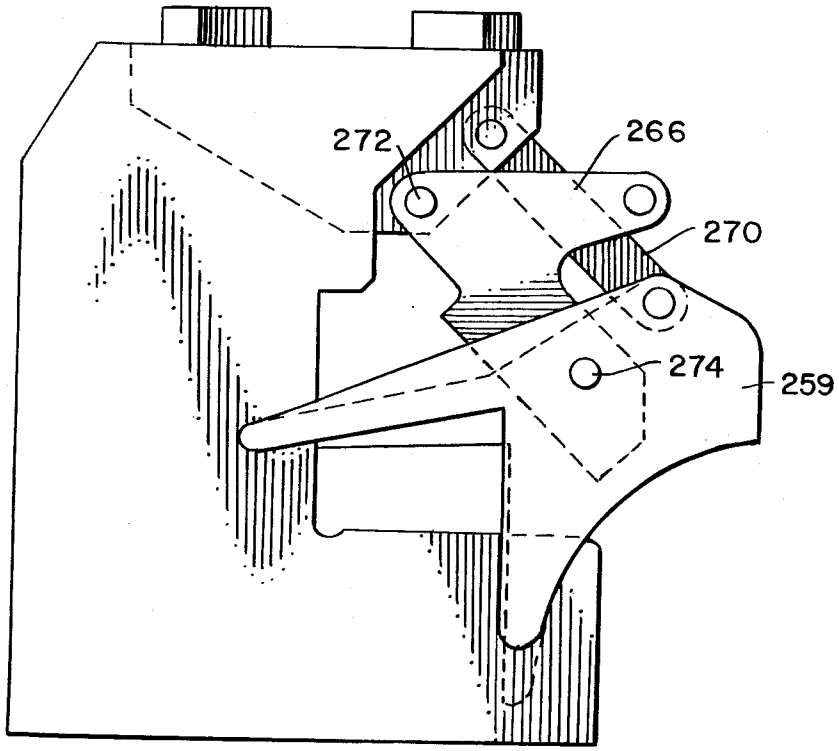
FIG. 16 PRIOR ART

FIGS. 8–14 are schematic views of the jaws 156 and 158 as incorporated in the present invention in combination with the drive arm 160 and link 162. The construction and operation of these jaws 156, 158 are important features of the invention. A more complete explanation of the construction of these jaws is thus presented. For purposes of contrast and distinguishment from the prior art, FIGS. 15–17 are provided.

Figure 8:
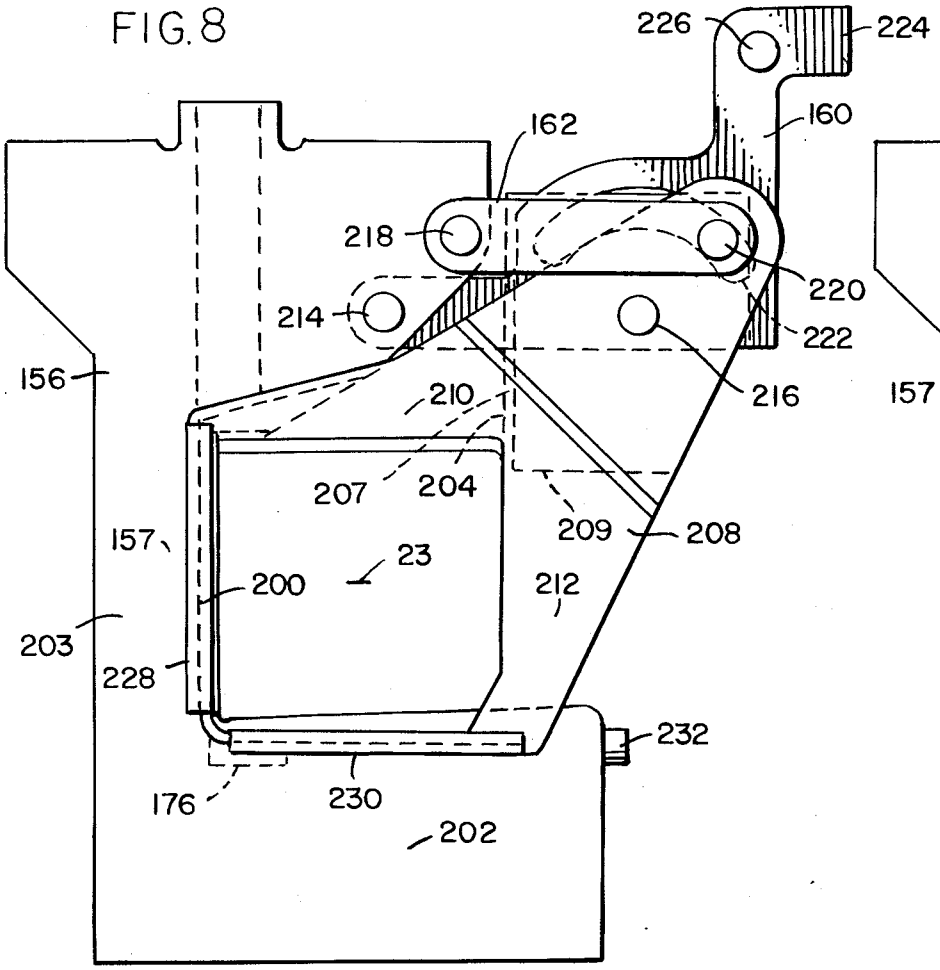
Figure 11:
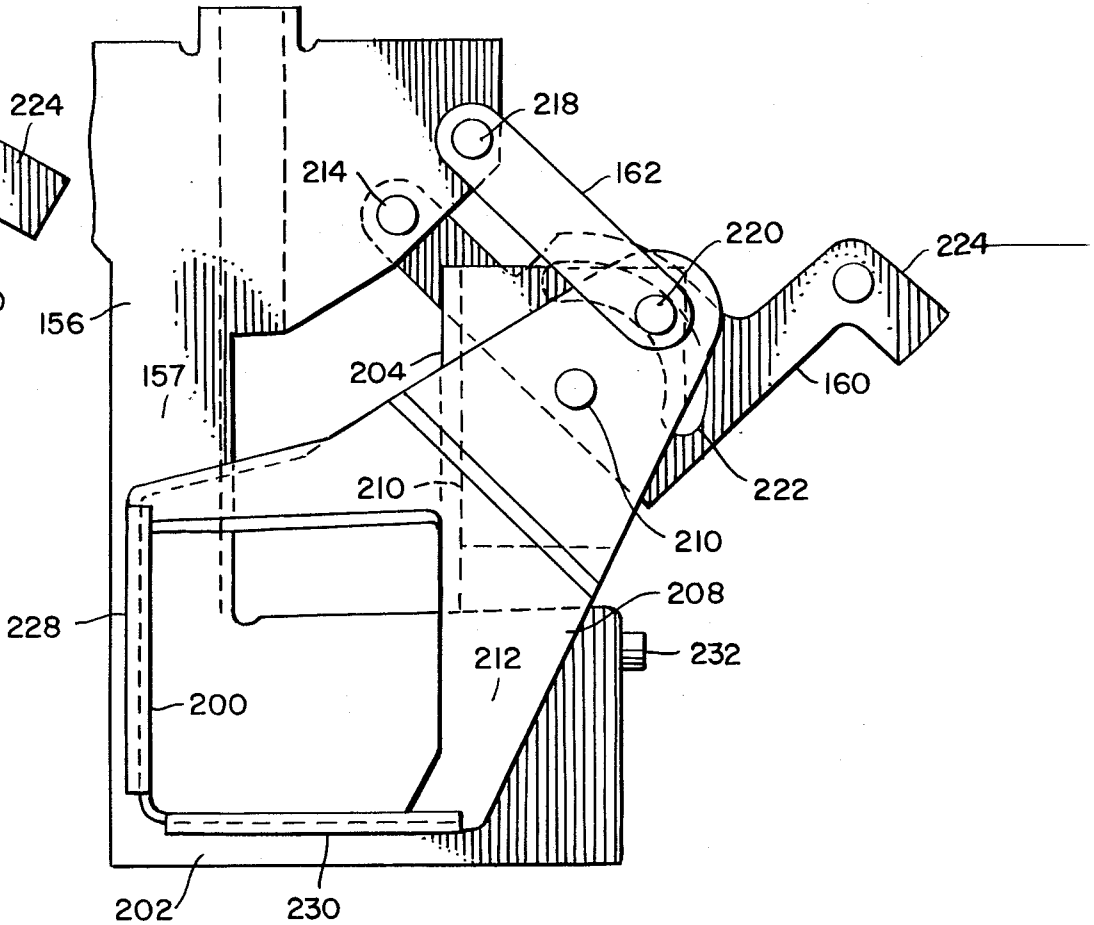

Referring therefore to FIGS. 8–14 and beginning with FIG. 8, FIG. 8 represents the arrangement of the jaws 156, 158 of the present invention in their fully open position. As shown in FIG. 8, the fixed plate 156 defines a fixed clip channel 200 for receipt of a leg of a metal clip 149. At the bottom of the channel 200, a die block 176 is supported by a fixed arm 202 of the plate 156.

The movable jaw 158 also includes a clip channel 204 which is defined on a channel plate section 206 of the movable jaw assembly. That is, the movable jaw 158 includes an outer gathering plate 208 and a parallel clip channel defining plate 206 which is shown in FIG. 7 affixed to the outer gathering plate 208. The outline of the border of the channel plate 206 is depicted in FIG. 8.

One border 207 of the plate 206 defines the clip channel 204. The other border 209 cooperates with an opposing plate 202 associated with the fixed plate 156. The outer plate 208 defines a horizontal movable jaw 210 which is parallel to the fixed arm or jaw 202. Plate 208 also defines a vertically extending movable jaw 212. The jaws 210 and 212 intersect to define a generally L-shaped configuration.

In the same manner, the fixed plate 156 defines a vertical jaw 203 and a horizontal jaw 202 which define a generally L-shaped configuration. The drive arm 160 is attached to the fixed plate 156 by pivot pin 214. Arm 160 connects to a fixed pivot point on plate 208 by pivot pin 216. The separate link 162 connects to the plate 156 by pivot pin 218. Link 162 also connects to the jaw 156 (plate 208) by a pivot pin 220. Note that the pivot pin 220 slides in an arcuate channel 222 defined in the drive arm 160. Note also that the drive arm 160 includes a stop tab 224. The drive arm 160 further includes a bushing passage 226 for receipt of and cooperation with bushing 174.

The arms 210 and 212 are connected at their distal ends by means of an L-shaped kick out bar assembly comprised of bars 228 and 230. Thus, the arms 210 and 212 in combination with the bars 228 and 230 define a generally rectangular passage through which casing and product pass during the filling operation of the device prior to any operation of the gathering arms.

FIGS. 9–14 illustrate the sequence of operation of the movable jaw and channel bar (plate 158) as it moves in 150 increments in response to the drive arm 160. The plate 158 and attached components pivot about the pins 214 and 218 always maintaining the channel 204 generally parallel to the channel 200. The arms 210 and 212 also remain generally parallel to the arms 202 and 203. The generally rectangular opening defined by the movable plate 158 and the fixed plate 156 thus becomes smaller and smaller thereby gathering casing material 28 over the die 176. Note that the linkage and plate shape is designated to gather the casing 28 in the vertical direction (in FIGS. 8–14) at a faster initial rate relative to the rate of horizontal gathering. This provides the added benefit of further reducing stress on casing 28 during the gathering operation. Also, the gathering plates may be of slightly different size to vary the rate and amount of gathering along the direction of axis 23. This variance accommodates the fact that the casing 28 is gathered the maximum amount at the midpoint between clip attachment points. The casing 28 therefore diverges in both directions from the center of the clippers 33, 35.

Figure 14:
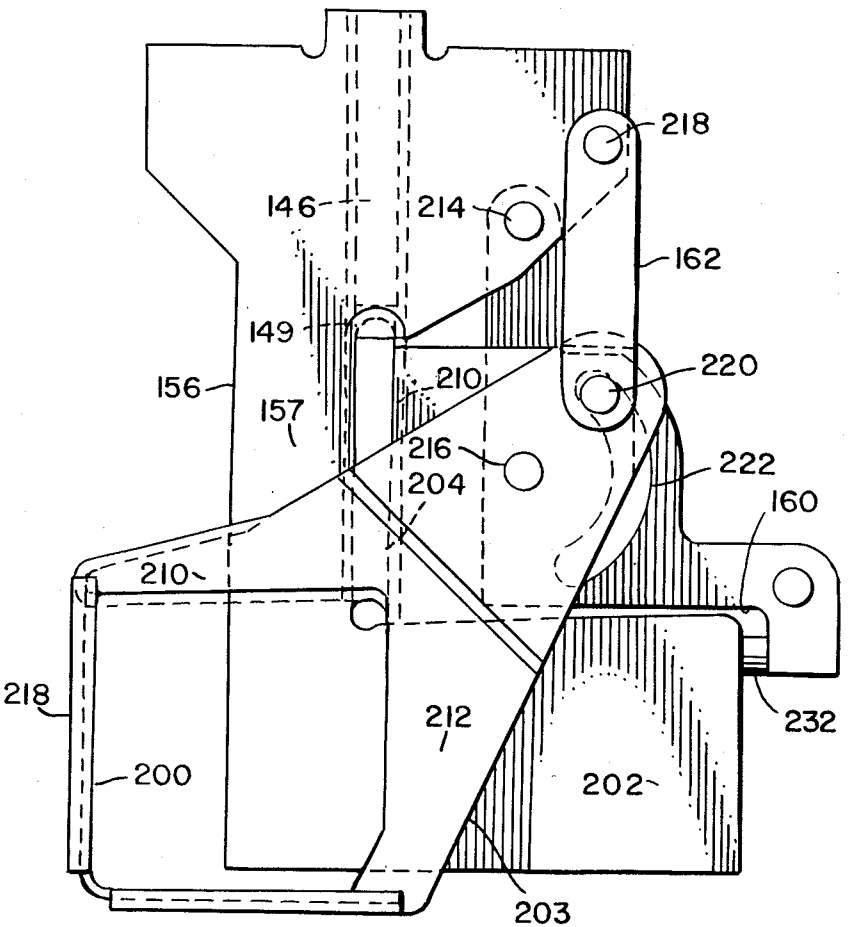

As the drive arm 160 is pivoted to its fully closed position represented by FIG. 14, the stop 224 engages against an adjustable bumper 232 to limit the travel of the plate 158. The shape of the channel defined by channel sides 200 and 204 is thus ensured. The closing of the plate 158 thus is fixed at a desired position.

Figure 9:
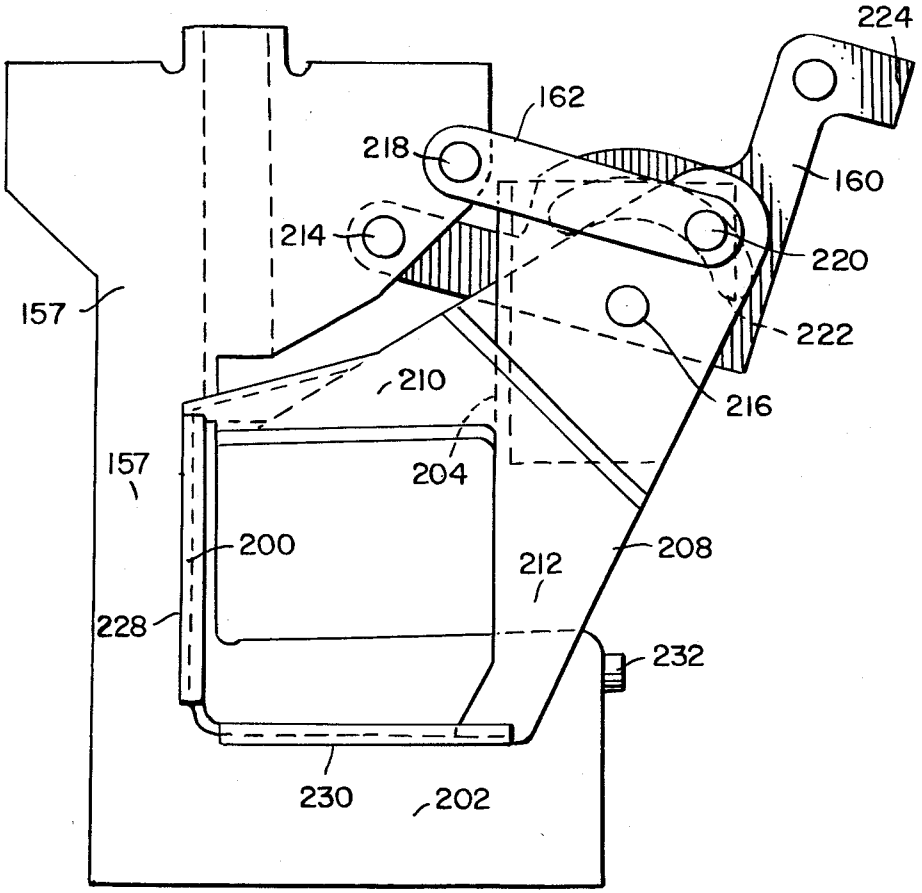
FIGS. 8–14 are schematic end views of the fixed and movable jaw members associated with the clipper of FIG. 6 as the movable jaw member moves in 15° increments from a fully opened to a fully closed clip attachment position.
Figure 10:
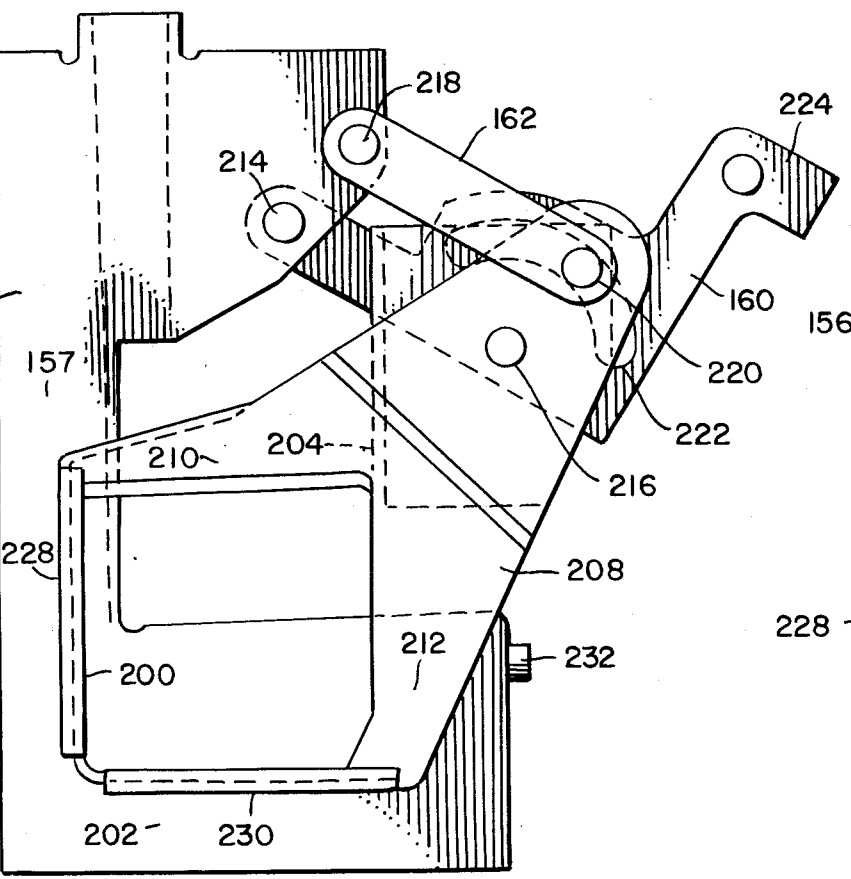
Figure 13:
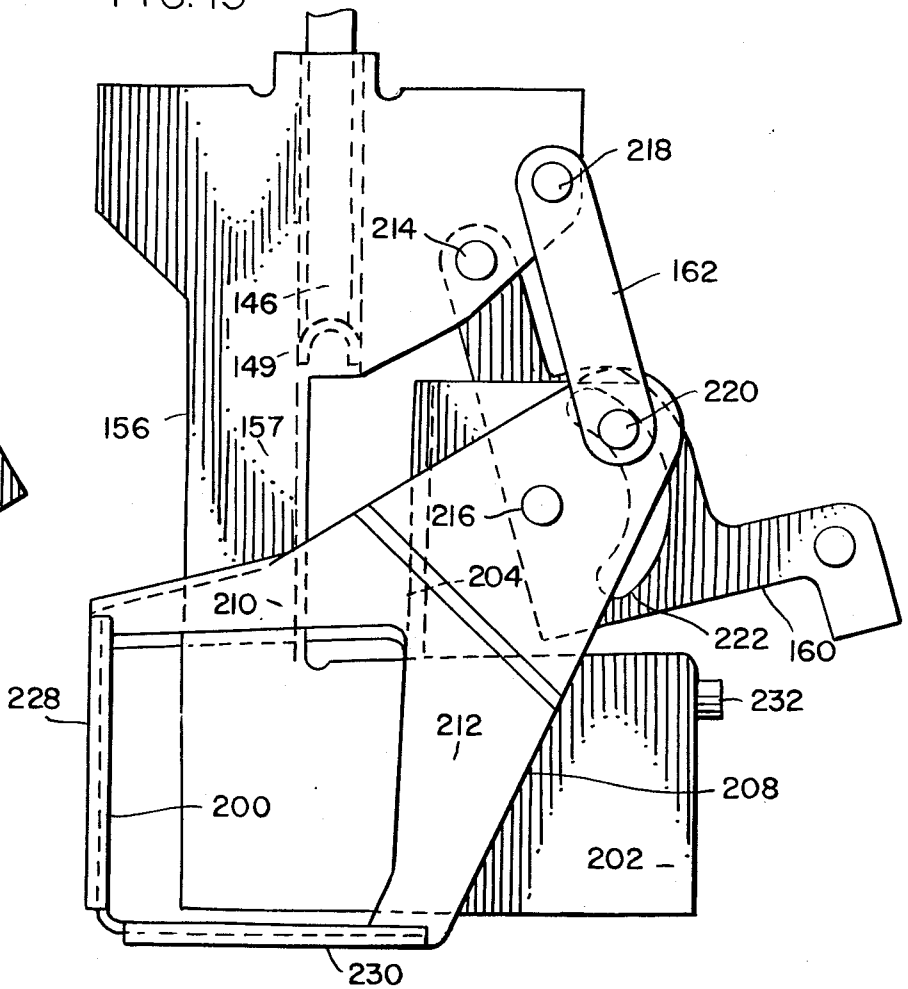
Figure 12:
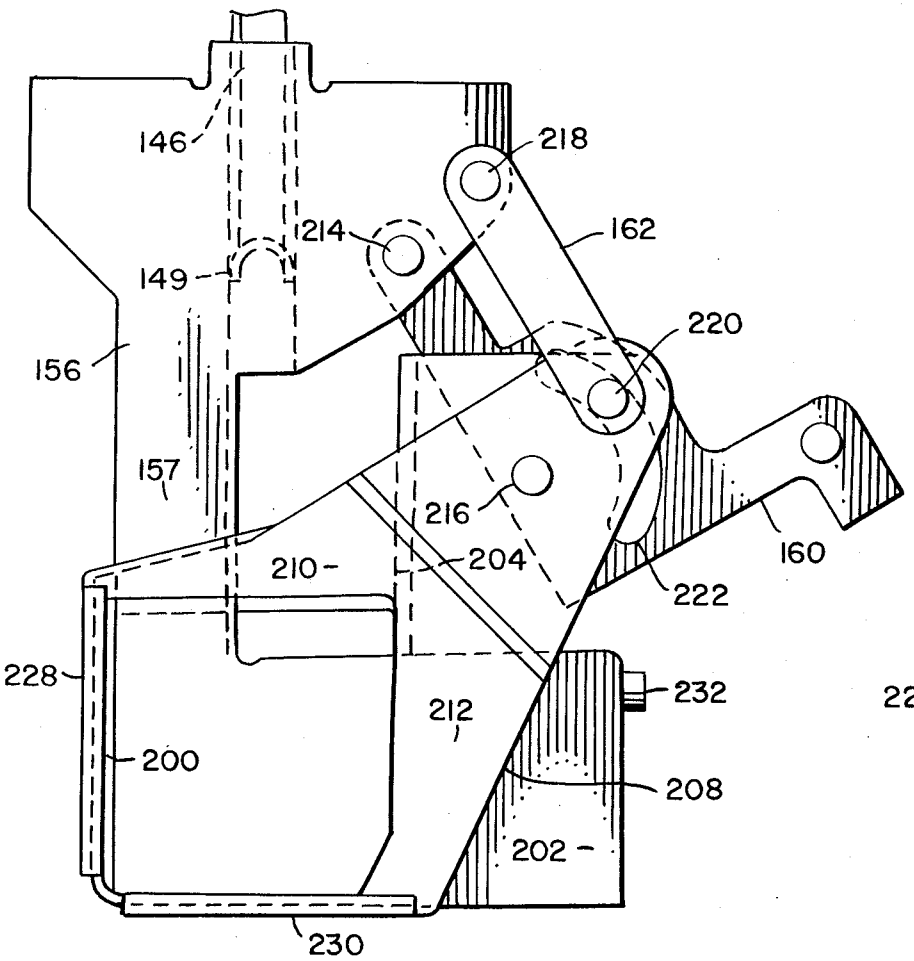

In review, FIG. 9 thus shows the drive arm 160 having moved through a 15° rotation. FIG. 10 shows a 30° rotation, FIG. 11 a 45° rotation, FIG. 12 a 60° rotation, FIG. 13 a 75° rotation, and FIG. 14 a total 90° rotation of the drive arm 160 so as to totally close the plate 158 thereby forming the clip channel and also simultaneously gathering the material.

Only a single plate 158 and associated channel have been described. In practice, as shown in FIG. 7, two movable jaws and plates 208 are provided to define two channels for two clips. The jaws 208 operate in unison.

Note that as the jaw and channel close, the bars 228 and 230 move in unison down and to the left in FIGS. 8–14. Thus, as the filled casing material is gathered and then clipped, the product will tend to rest and be supported on the bars 228 and 230. During the reverse sequential operation of the drive arm 160, the bars 228 and 230 will lift and remove the product thereby removing casing from the die 176. This will align the clipped casing properly with the horn 72 substantially along the axis 23 as shown in FIG. 8. Thus, during the clipping operation, the product is moved off center with respect to the horn axis 23. After clipping with the improved construction of the present invention, there is a positive movement of the product back to the appropriate center line axis 23 as a result of bars 228, 230.

Also, since during the gathering action the channel 204 is maintained in alignment with the channel 200, there is no pinching or tearing of the casing material during the closing operation of the jaw 158. Further, when the plate 158 is closed, the brake mechanism 26, previously described, operates to disengage the brake member 103 from the casing by operation of cylinder 90 which moves the entire mechanism 26 to the right in FIG. 2 thereby releasing the casing 28 so that the described gathering and clipping operation will not result in tearing or severing of the casing material 28.

FIGS. 15–17 are included for illustrating what is believed to be the most closely related prior art. In FIG. 15, it will be noted that there is a fixed plate 250. The fixed plate 250 cooperates with a movable jaw and channel assembly 251. The fixed plate 250 thus defines a fixed clip channel 254 associated with a fixed arm 256. An L-shaped arm 258 extends therefrom for support of a die 260. A separate, movable channel forming movable plate 257 is provided for pivotal action to move simultaneously with a pivotal gathering arm 259. Thus, plate 257 defines a channel 261 which pivots through approximately 90° as would be evident from reviewing FIGS. 15, 16 and 17 to close on the gathered material and form a complete clip channel. The gathering arm 259 operates independently of the clip channel plate 257. As a result, it is possible for pinching or tearing movements to occur between the plate 259 and the channel plate 257.

FIG. 16 depicts an intermediate position of the channel forming plate 257. A link 270 connects the fixed jaw 250 with the movable jaw 259. The channel forming plate 257 is also connected through a pivot point 272 on jaw 256 to a pivot point 274 associated with the plate 259. Plate 257 thus is a link for plate 259. The linkage provides that the plate or channel bar 257 pivots through an angle of approximately 90° whereas by contrast with the construction of the present invention, the channel bar 206 maintains a constant, vertical orientation during the closing operation. Additionally, the construction depicted in FIGS. 15–17 does not include the kick out bar assembly as provided in the present construction.

While there has been set forth a preferred embodiment of the invention, it is to be understood that the invention is to be limited only by the following claims and their equivalents.

What is claimed is:

1. In a packaging device for filling tubular casing with product and for attaching metal clips about the casing at intervals to enclose the product, said device of the type including a frame;

a generally cylindrical product discharge horn mounted on the frame, said horn defining an axis and having a product discharge end;

means for feeding product into the horn for ultimate discharge from the product discharge and;

means for maintaining casing on the outside of the horn for withdrawal therefrom as the casing is filled with product, at least one metal clip having been attached to the casing before said means for feeding discharges product into the casing;

brake means supported by the frame for controlling the withdrawal of casing from the horn; and clip attachment means supported by the frame for fastening a generally U-shaped metal clip about the casing withdrawn from the horn thereby sealing the casing, the improvement comprising, in combination:

an improved brake mechanism cooperative with the horn, said brake mechanism including:

a generally cylindrical brake member having an internal diameter section cooperative with the discharge end of the horn to control tension on casing passing between the inside of the brake member and the outside of the horn as product is discharged from the horn into casing;

a support plate for the brake member; and means for attaching the support plate to the frame, said means for attaching including means for translating the plate and brake axially with respect to the horn between a position of cooperative engagement of the brake member with the horn and a position wherein the brake member is axially spaced from the discharge end of the horn, said means for attaching also including means for pivoting the brake member away from axial alignment with the horn whereby the horn is exposed for full access and wherein said plate is mounted on a rod extending along a second axis parallel to the horn axis, said rod extensible to displace the plate member and brake from the end of the horn, said rod also rotatable about said second axis whereby the brake may be pivoted from alignment with the horn axis to non-alignment with the horn axis.

2. The improvement of claim 1 wherein said support plate comprises a generally planar plate member extending generally transverse to the axis, and said means for pivoting comprises means defining a second axis parallel to the horn axis, said second axis spaced from the horn axis.

3. The improvement of claim 1 wherein the rod is supported by an auxiliary frame which is slidably mounted on the frame, said auxiliary frame movable in the direction of the horn axis, and including means for adjusting the position of the auxiliary frame axially with respect to the frame, whereby the axial position of the brake on the horn is adjusted by said means for adjusting and the rod is also axially extensible from the auxiliary frame to axially separate the brake member from the horn and to pivot the support plate about the second axis.

4. The improvement of claim 1 wherein the horn is cylindrical and includes an end section with an outside diameter at the discharge end greater than the outside diameter upstream from the discharge end, and wherein the brake mechanism comprises an a cylinder member which fits over the horn, said cylinder member including an elastomeric ring projecting radially into the cylinder for cooperative engagement with casing on the horn whereby the ring engages the casing against the horn at the outside end to control tension on the casing as it is withdrawn from the horn.

5. The improvement of claim 4 wherein the diameter of the elastomeric ring is less than the horn diameter at the outside end section and greater than the horn diameter upstream.

6. The improvement of claim 4 wherein the discharge end comprises an enlarged cylindrical section at the end of the horn defined between the end of the horn and a circular flange on the horn upstream from the end, said flange defining the transition, between the reduced diameter upstream portion of the horn and the enlarged cylindrical section.

7. The improvement of claim 1 wherein the clipper is pivotally mounted on the frame for movement between axial alignment with the horn and pivoting away from the horn.

8. The improvement of claim 1 wherein the clipper attachment means includes a fixed clip channel member defining one side of a clip channel with a fixed support at the end of the channel for supporting a clip forming die, and the clipper attachment means also includes a movable channel bar and jaw defining, at least in part, the opposite side of the clip channel, said movable channel bar and jaw connected by a linkage means to the fixed jaw to maintain the movable side of the clip channel substantially parallel to the fixed channel side as said movable side is transported from a fully open position to a closed, channel forming position;

said channel bar and jaw also including a material gathering jaw movable therewith to gather material at the end of the closed channel as the channel bar and jaw is transported from a fully open position to a closed, channel forming position; and said linkage means is operative to translate the channel bar and jaw simultaneously in two directions toward the die thereby maintaining the movable channel side and jaw oriented in a substantially common orientation at all times of translation.

9. The improvement of claim 8 wherein the fixed clip channel member includes a fixed jaw with a fixed channel side and with a die support side extending substantially transversely therefrom to form a generally L-shaped fixed jaw opening with a clip die at the juncture of the channel side and die support side.

10. The improvement of claim 9 wherein the movable channel bar and jaw includes a gathering arm parallel to the channel side and a generally transverse gathering arm parallel to the fixed die support, said arms also forming a generally L-shaped movable jaw opening with the sides thereof opposed to the fixed jaw sides at all times to thereby define a generally rectangular opening for passage of filled casing when the jaws are fully open, said movable channel bar and jaw movable to compress the casing and contents to a position over the die by maintaining a continuously decreasing sized, generally rectangular opening between the fixed jaw and the movable material gathering jaw.

11. The improvement of claim 8 wherein the linkage means comprise first and second linkage arms, each arm connected from a pivot point on the fixed clip channel member to a pivot point on said movable channel bar and jaw.

12. The improvement of claim 11 wherein one of the linkage arms includes a stop tab cooperative with the fixed clip channel member to limit pivotal motion of the linkage arms toward the material gathering position.

13. The improvement of claim 10 including a lift plate connected to at least one of the gathering side arms of the movable channel bar and jaw to thereby encircle the opening and move with the channel bar and jaw to lift the filled and clipped casing from the die after attachment of a clip.

14. In a packaging device for filling tubular casing with product and for attaching metal clips about the casing at intervals to enclose the product, said device of the type including a frame;

a generally cylindrical product discharge horn mounted on the frame, said horn defining an axis and having a product discharge end;

means for feeding product into the horn for ultimate discharge from the product discharge end;

means for maintaining casing on the outside of the horn for withdrawal therefrom as the casing is filled with product, at least one metal clip having been attached to the casing before said means for feeding discharges product into the casing;

brake means supported by the frame for controlling the withdrawal of casing from the horn; and clip attachment means supported by the frame for fastening a generally U-shaped metal clip about the casing withdrawn from the horn thereby sealing the casing, the improvement comprising, in combination:

improved casing gathering means for the clip attachment means, said gathering means including a fixed clip channel member defining one side of a clip channel with a fixed support at the end of the channel for supporting a clip forming die; a movable channel bar and jaw defining, at least in part, the opposite side of the clip channel, said movable channel bar and jaw connected by a linkage means to the fixed member to maintain the movable side of the clip channel substantially parallel to the fixed channel side as said movable side is transported from a fully open position to a closed, clip channel forming position;

said channel bar and jaw also including a material gathering jaw movable therewith to gather material at the end of the closed clip channel as the channel bar and jaw is transported from a fully open position to a closed, clip channel forming position; and said linkage means is operative to translate the channel bar and jaw simultaneously in two directions toward the die thereby maintaining the movable channel side and jaw oriented in a substantially common orientation at all times of translation.

15. The improvement of claim 14 wherein the fixed clip channel member includes a fixed jaw with a fixed channel side and with a die support side extending substantially transversely therefrom to form a generally L-shaped fixed jaw opening with a clip die at the juncture of the channel side and die support side.

16. The improvement of claim 15 wherein the movable channel bar and jaw includes a gathering arm parallel to the channel side and a generally transverse gathering arm parallel to the fixed die support, said arms also forming a generally L-shaped movable jaw opening with the sides thereof opposed to the fixed jaw sides at all times to thereby define a generally rectangular opening for passage of filled casing when the jaws are fully open, said movable channel bar and jaw movable to compresss the casing and contents to a position over the die by maintaining a continuously decreasing sized, generally rectangular opening between the fixed jaw and the movable material gathering jaw.

17. The improvement of claim 14 wherein the linkage means comprise first and second linkage arms, each arm connected from a pivot point on the fixed clip channel member to a pivot point on said movable channel bar and jaw.

18. The improvement of claim 17 wherein one of the linkage arms includes a stop tab cooperative with the fixed clip channel member to limit pivotal motion of the linkage arms toward the material gathering position.

19. The improvement of claim 16 including a lift plate connected to at least one of the gathering side arms of the channel bar and jaw to thereby encircle the opening and move with the channel bar and jaw to lift the filled and clipped casing from the die after attachment of a clip.

* * * * *